United States Patent [19]

Tarr, Jr.

[11] Patent Number: 4,817,835

[45] Date of Patent: Apr. 4, 1989

[54] GUN SLING

[75] Inventor: Edmund S. Tarr, Jr., Cody, Wyo.

[73] Assignee: Cody Trading Post, Inc., Scottsville, Va.

[21] Appl. No.: 90,373

[22] Filed: Aug. 28, 1987

[51] Int. Cl.[4] ..... F41C 33/00

[52] U.S. Cl. ..... 224/150; 224/258; 224/913

[58] Field of Search ..... 224/150, 913, 153, 202, 224/257, 258, 915, 916, 917

[56] References Cited

U.S. PATENT DOCUMENTS

| | | | |
|---|---|---|---|
| 202,663 | 11/1935 | Palmer | 224/214 |
| 2,715,989 | 8/1955 | Sjodin et al. | 224/913 X |
| 3,182,871 | 5/1965 | Gossler | 224/913 X |
| 3,595,451 | 7/1971 | Branby | 224/150 |
| 4,182,469 | 1/1980 | Bennett | 224/150 |
| 4,311,263 | 1/1982 | Bianchi | 224/150 |

*Primary Examiner*—Charles E. Phillips

*Attorney, Agent, or Firm*—Nixon & Vanderhye

[57] ABSTRACT

A versatile gun sling is disclosed which allows a gun to be carried either over a person's shoulder or across their back. The gun sling is made of a long strap slit longitudinally. The strap is broader on the end which connects to a gun's buttstock, allowing optimum weight distribution across the bearer's back. The gun sling's length is adjusted by folding the strap so the opposite end of the strap may be connected to the strap, forming a loop in the strap. The gun sling is attached to a gun by two swivel rings held in loops in the strap on each strap end. One swivel ring resides in the loop formed in the strap by folding the strap to adjust the length; the second loop is formed by folding the buttstock end region of the strap onto itself and fastening it in place.

9 Claims, 2 Drawing Sheets

GUN SLING

BACKGROUND OF THE INVENTION

1. Field of the Invention

This invention relates generally to an article carrier and more specifically to a sling for a gun.

2. Description of the Prior Art

Since long guns (rifles, shotguns, etc.) are physically large and relatively heavy, gun slings have commonly been used. Gun slings especially help hunters or soldiers who may be outdoors carrying a gun for long periods of time and allows these people to move freely while accomplishing other tasks.

Many designs for gun slings are known. Designs for back packs or outdoor equipment carriers also pertain to gun sling designs. U.S. Pat. No. 202,663 to Palmer is an early, relatively complicated design for a back pack to carry military hardware. This design, being physically cumbersome and extremely detailed, makes it expensive, impractical and unappealing for the average hunter. U.S. Pat. No. 2,715,989 to Sjodin et al is a shoulder harness for carrying a gun. This patent applies a basic back pack design to a gun carrier. Again this is a relatively complicated structure of straps and since the gun is anchored securely across a person's back, it is time consuming to remove the gun, posing a problem for hunters. U.S. Pat. No. 4,311,263 to Bianchi is a gun sling with a thumb support. This relatively simple design allows a gun to be carrier over one shoulder and easy access to the gun results. However, this design has the problem that the gun occupies one arm of the person using the carrier. Also, the weight of the gun is unevenly distributed across the body, which may cause fatigue. A life threatening gun discharge is more probable in this carrier design than in the back pack design.

BRIEF SUMMARY OF THE INVENTION

It is therefore an object of the present invention to provide a gun sling which distributes the load more evenly over one shoulder.

It is a further object of the present invention to provide a comfortable lightweight gun sling which allows the gun to be carried either over one shoulder or back pack style.

The above and other objects are achieved in accordance with the present invention by providing a single strap, split longitudinally, and a means for adjusting the strap's length, and a means for attaching the strap to the gun.

BRIEF DESCRIPTION OF THE DRAWINGS

By way of example, these figures may aid an understanding of the structure of this invention.

DETAILED DESCRIPTION OF THE INVENTION

Figure 1:
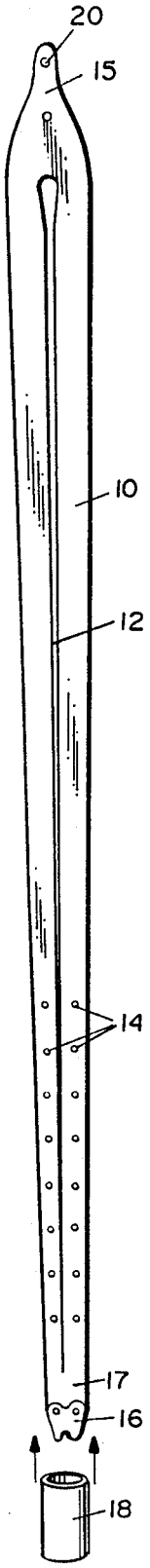
FIG. 1 is a top, elevational view of the gun sling, unattached to a gun.

Similar numerals designate similar elements among the several figures, wherein FIG. 1 shows the sling's structure. The sling design is a long strap 10 with a slit 12 parallel to the length of the strap 10. The strap 10 is best made of a strong, flexible material, like leather or nylon. In the preferred embodiment of this invention, slit 12 is positioned on strap 10 so that slit 12 ends three inches from one end of strap 10, the fore-end region 15, and two inches from the other end, the buttstock region 17. Also in the preferred embodiment of the invention the end of strap 10, just below fore-end region 15, is wider than the opposite end. This allows the weight of the gun 26 to be better distributed across the bearer's shoulders.

Figure 2:
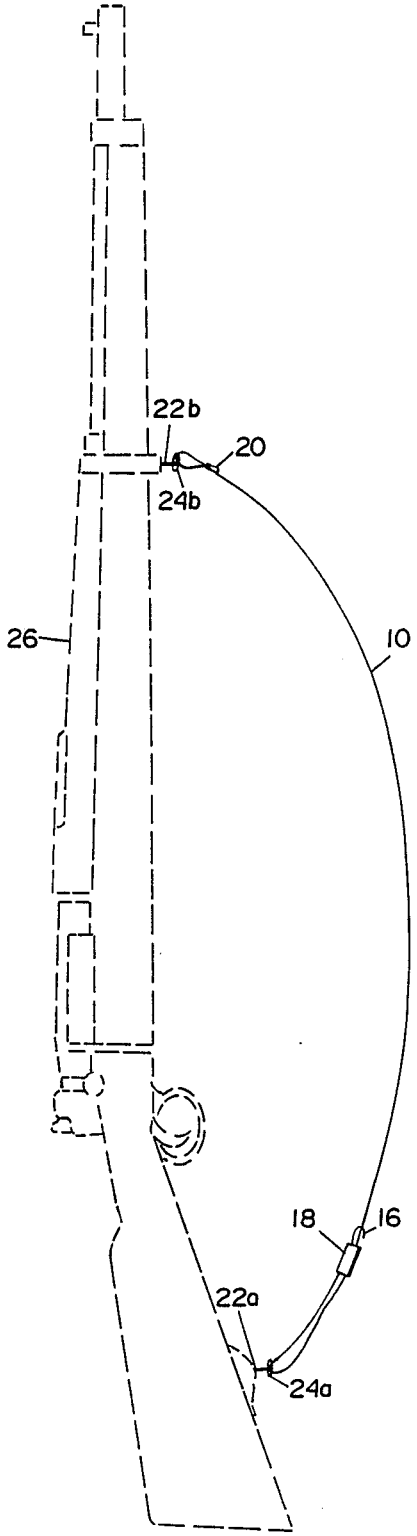
FIG. 2 is a side view of the gun sling, attached to a gun.

FIGS. 1 and 2 show how to adjust the length of the sling. Preferably, the length is adjusted by a military keeper 16, on the buttstock end region 17, and holes 14 into which the military keeper 16 connects. By folding the end of the strap 10 nearest buttstock end region 17, the military keeper 16 may be connected into the holes 14 forming a first loop in strap 10. Thus, the end-to-end length of the gun sling is shortened. Once connected into these holes 14 a keeper slide 18 on the strap 10 slides over the military keeper 16 to secure the military keeper's position.

FIG. 2 shows the preferred way to connect the sling to a gun. There are two swivel rings **22*a* and 22*b* for connection to gun swivels 24*a* and 24*b*. One swivel ring 22*a* encircles the loop formed by the length adjusting means. This end of strap 10 connects to the buttstock end of gun 26. The other swivel ring 22*b* encircles the second loop on the fore-end end region of strap 10. This second loop is formed by folding over the fore-end end region 15. This loop is fully above slit 12. The second loop is secured by a threaded fastener 20**.

FIG. 2 shows how the gun sling functions as connected to gun 26. The strap 10 attaches to two points on the gun 26 at the gun swivels **24*a* and 24*b*. Swivel rings 22*a* and 22*b* are the points of attachment between the gun swivel 24*a* and 24*b* and the strap 10. The strap 10 is adjusted to be long enough to connect to the two gun swivels 24*a* and 24*b*** and to comfortably accommodate the gun bearer's torso.

Figure 3:
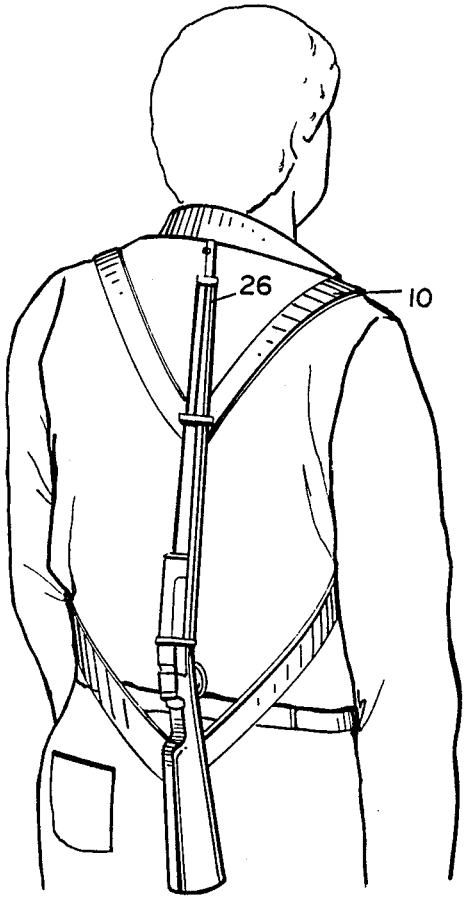
FIG. 3 is a perspective view of the gun and gun sling mounted back pack style on a human torso rotated one-quarter from full back view, as seen from behind.

FIG. 3 shows a unique feature of this invention, showing that each sling half may be over a different shoulder allowing the gun 26 to be carried back pack style. Also, the two sling halves may be carried over one shoulder with the strap halves more evenly conforming to the shoulder itself.

In view of the above disclosure many modifications and variations of the invention will be obvious to one of ordinary skill in the art. For example, different materials other than leather or nylon could be used for the sling. Different length changing means could also be used, for example buckles, and/or hook and pile fasteners (VELCRO®) therefore the invention is limited only by the claims appended hereto.

I claim:

1. A gun sling, for carrying a gun, said sling comprising:

a strap, having a longitudinal axis and two opposite end regions, said strap including means for dividing said strap into two halves, said means comprising a slit parallel to said longitudinal axis;

means for attaching each of said end regions to said gun at two spaced apart points on said gun; and means for changing the length of said strap, said length changing means comprises:

means defining at least two holes in each strap half, said holes on said strap half aligned longitudinally;

keeper means, having at least two hooks, said keeper means on at least one of said end regions, mounted for connection to a respective hole on each strap half, said keeper means forming a first loop on said strap; and a keeper slide, for sliding over and securing said keeper means when said at least two hooks are inserted in respective holes on each of said strap halves.

2. A gun sling as recited in claim 1, wherein said length changing means comprises a single keeper means, wherein said attaching means on the end region opposite said keeper means further comprises:

means for forming a second loop; and means for securing an end of said second loop to said end region opposite said keeper means end region.

3. A gun sling as recited in claim 1, wherein said strap is wider toward said end region opposite said first loop.

4. A gun sling as recited in claim 3, wherein said strap is wider toward said end region opposite said keeper means.

5. A gun sling as recited in claim 4, wherein said attaching means on the keeper means end of said sling further comprises:

a first swivel ring, having a first link and a means for attachment to said gun, said first loop extending through said first link.

6. A gun sling as recited in claim 5, wherein said attaching means on said wider end of said sling further comprising:

a second swivel ring, having a second link and a means for attachment to said gun, said second loop extending through said second link.

7. A gun sling as recited in claim 6, wherein said strap is comprised of nylon.

8. A gun sling as recited in claim 6, wherein said strap is comprised of leather.

9. A gun sling for carrying a gun, said sling comprising:

a leather strap having a longitudinal axis and two opposite end regions, said strap having a wide end and a narrow end toward said respective, opposite end regions, said strap including means for dividing said strap into two halves, said means comprising a slit parallel to said longitudinal axis;

means defining at least two holes in each strap half, aligned longitudinally;

a keeper means having at least two hooks, said keeper means mounted on said end region toward said narrow end of said strap for connection to a respective hole on each strap half, forming a first loop on said strap;

a keeper slide, for sliding over and securing said keeper means when said hooks are inserted in respective holes on each of said strap halves;

a first swivel ring, comprised of a first link and a means for attachment to said gun, said first loop extending through said first link of said first swivel ring;

a threaded fastener on said end region toward said wide end of said strap, for connection to said end region, forming a second loop; and a second swivel ring, comprised of a second link and a means for attachment to said gun, said second loop extending through said second link of said second swivel ring.

* * * * *